United States Patent [19]

Sroka

[11] 4,188,150

[45] Feb. 12, 1980

[54] HIGHWAY LANE MARKER

[76] Inventor: Edward A. Sroka, 79 Lexington St., Waltham, Mass. 02154

[21] Appl. No.: 924,143

[22] Filed: Jul. 13, 1978

[51] Int. Cl.[2] ..... E01F 9/00

[52] U.S. Cl. ..... 404/11

[58] Field of Search ..... 404/10, 11, 9, 15, 16, 404/14

[56] References Cited

U.S. PATENT DOCUMENTS

| | | | |
|---|---|---|---|
| 1,599,986 | 9/1926 | Chapel | 404/11 |
| 2,157,059 | 5/1939 | Rosener | 404/11 |

FOREIGN PATENT DOCUMENTS

| | | | |
|---|---|---|---|
| 216369 | 7/1958 | Australia | 404/11 |
| 701887 | 1/1941 | Fed. Rep. of Germany | 404/11 |
| 1164452 | 3/1964 | Fed. Rep. of Germany | 404/11 |
| 1421151 | 1/1976 | United Kingdom | 404/11 |

*Primary Examiner*—Nile C. Byers, Jr.

[57] ABSTRACT

A highway marker comprising a spherical member mounted in a housing so that a portion of the spherical member projects from the housing. The spherical member is so mounted that axial movement within the housing and rotational movement of said member is permitted.

8 Claims, 5 Drawing Figures

HIGHWAY LANE MARKER

FIELD OF THE INVENTION

This invention relates to lane markers for highways, particularly to lane markers of the type adapted to be mounted in the road bed and having a portion project from the road surface to indicate traffic lanes without interfering with the movement of vehicles over or upon the markers.

DESCRIPTION OF THE PRIOR ART

Highway lane markers of the type that are embedded in the road bed and project from the road surface to indicate traffic lanes are well known. Reflective highway markers of the type described above when placed along designated traffic lanes are highly desirable and preferable to the usual painted dividing lines on most roads, not only because such markers act like unmistakable light beacons in the dark and are clearly visible to a driver over a considerably greater distance than the usual white or yellow traffic lines, but also because they will function properly in many instances where traffic lines are spotted by a driver only with difficulty, or not at all, as on wet or foggy roads, or on newly plowed roads, or in the light glare from oncoming automobiles, for example. Yet, even though quite a few reflective road markers are known, none of them are in use according to best information received, the reason therefor being that the prior markers are all too readily damaged or destroyed by wheels of fast-moving automotive vehicles passing over them occasionally, and especially by the heavy blades of snowplowing vehicles.

Typical such prior highway markers having the above mentioned problems are described in U.S. Pat. Nos. 2,073,968; 2,157,059; Australian Pat. No. 216,369; and German Pat. No. 701,887. Other similar devices used for various purposes as types of markers on streets and highways or even airplane runways are described in U.S. Pat. Nos. 1,825,667; 1,559,986; 1,777,585; 2,127,700; and 2,934,633. All of such markers generally suffer problems, particularly with respect to damage by heavy blades of snow plowing equipment. For instance, the road marker described in German Pat. No. 701,887, although being resiliently mounted by the rubber liner G, does not allow the ball to rotate because of frictional forces between the rubber and the ball surface and thus can be damaged when struck by the blade of a snowplow.

One attempt to solve the problem of damage to highway lane markers by snowplows is described in U.S. Pat. No. 3,292,506. This patent describes a highway marker with a frusto-conical top having a light reflective lens, the top being mounted in a resilient seating arrangement. This solution was not entirely satisfactory because, if the angle of the sides of the frusto-conical top were too steep, the marker would still suffer damage from snowplows, and if the angle is low enough to prevent such damage, the marker is too flat to reflect sufficient light to oncoming vehicles. Thus a better solution is still sought.

SUMMARY OF THE INVENTION

The present invention provides a highway lane marker comprising a housing and a substantially spherical member partially projecting from the housing and from the road surface when the lane marker is embedded in a roadway, the spherical member being mounted in the housing so that it is free to rotate within its housing and so that the surface of the sphere projecting from the road surface is no greater than that cut by a cone having an angle at its apex of about 150°.

The highway lane marker is permanently placed in a cored hole in the highway or other roadway surface where it is desired to control or guide vehicular traffic.

DETAILED DESCRIPTION OF THE INVENTION

Figure 1:
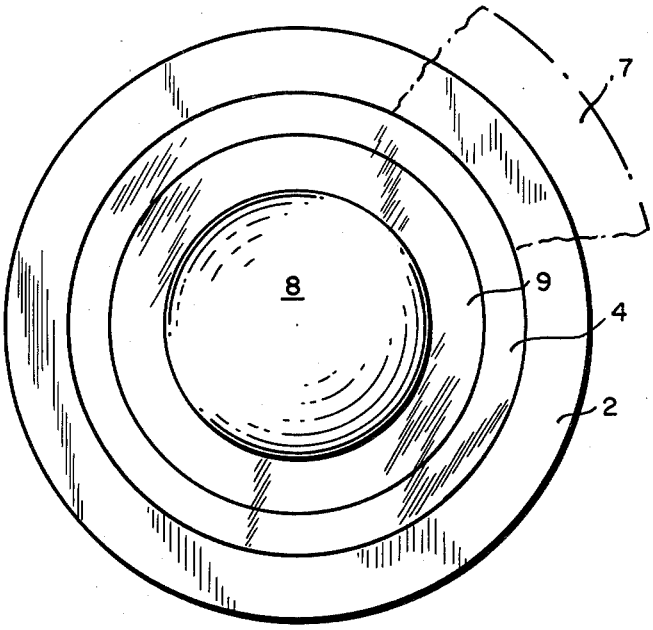
FIG. 1 is a plan view of a lane marker in accord with this invention.
Figure 3:
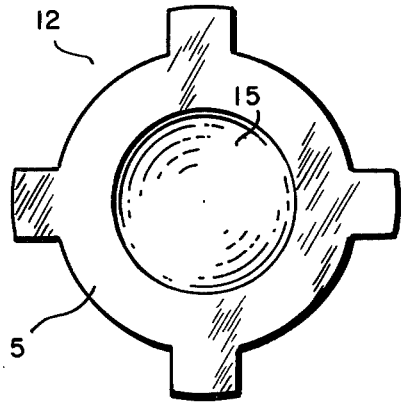
FIG. 3 is a plan view of a support spider for the sphere component of the lane marker illustrated in FIG. 2.
Figure 2:
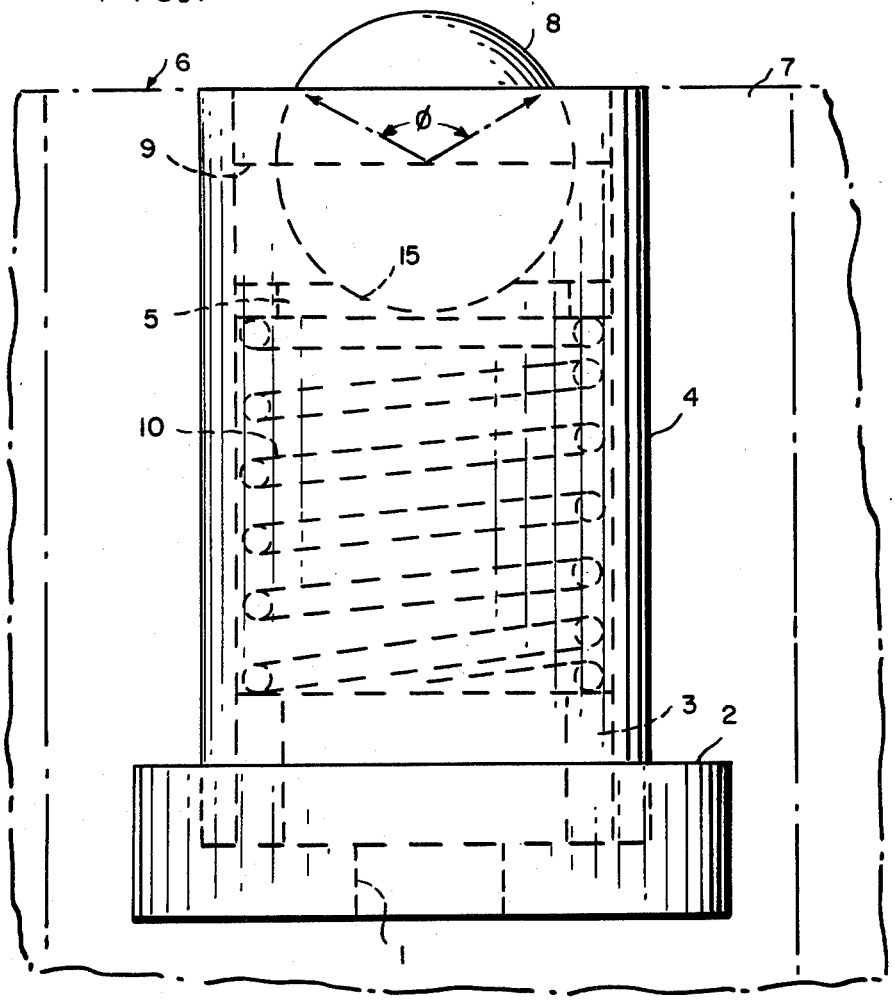
FIG. 2 is a side view of the lane marker of FIG. 1 being illustrated as placed in a roadbed.

A highway lane marker in accord with this invention comprises a housing, a substantially spherical member, means for retaining said spherical member so that a portion of said member projects beyond the end of said housing, and means for supporting said spherical member in said housing so that said spherical member can rotate, said supporting means being mounted resiliently within said housing so that said spherical member can move into the housing when force is exerted on the projecting portion of the spherical member.

With reference to the drawings, one embodiment of a lane marker in accord with this invention is constructed with a cylindrical housing 4. The housing 4 may be of any convenient cross-sectional shape. A cylindrical housing has been selected for illustration because it is conveniently provided by pipe or tubing of appropriate diameter. However, housings having a square or other cross-sectional shape can readily be used in the practice of this invention.

A cap 9 is provided at one end of the housing to retain a substantially spherical member or ball 8. The cap 9 has a hole therein to allow a portion of the ball 8 to project therethrough. Thus, when the lane marker is embedded in a roadway, a portion of the ball 8 will project above the road surface 6. Preferably, the cap 9 is removable for easy maintenance of said marker if required.

The ball 8 is resiliently supported by a spider 5 and a spring 10 which urges the ball 8 in contact with cap 9 and maintains its projection above the road surface 6, and further permits the ball 8 to move back into the housing when a force is exerted on the projecting surface of the ball. Thus, when a tire of a vehicle rolls over the lane marker, the ball 8 will move back into the housing 4 and will immediately return to its projected position when the force of the tire is removed.

Figure 4A:
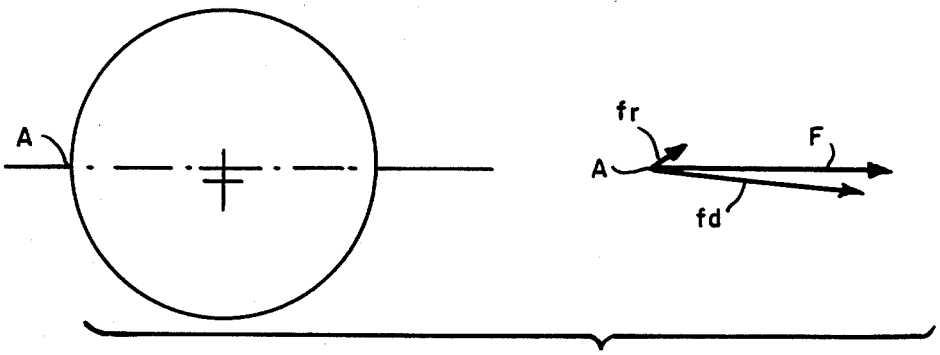
FIG. 4A PRIOR ART
FIG. 4*a* is a schematic drawing illustrating a prior art ball marker projecting from a road surface.
Figure 4B:
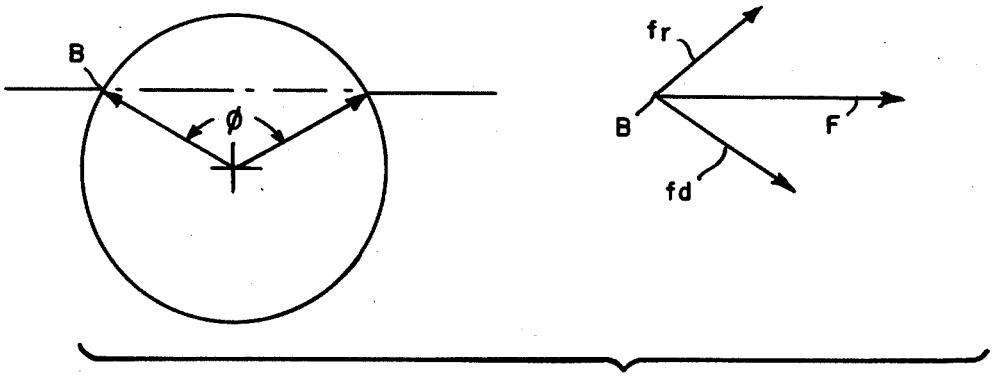
FIG. 4*b* is a schematic drawing illustrating a ball marker of an embodiment of the present invention projecting from a road surface.

The amount of the surface area of the ball 8 that projects from the housing 4 is very important in order to prevent damage by snowplow blades. As can be seen from the illustration in FIG. 4*b* where F indicates the force of the snowplow blade, $f_d$ illustrates the force component exerting downward pressure on the ball and $f_r$ indicates the force component causing rotational movement by the ball, the angle $\phi$ formed by a cone having its apex at the center of the ball and cutting the surface of the ball 8 where top surface of cap 9 and the ball intersect should be less than about 150° so that the force F will have a component $f_r$ of sufficient magnitude to cause the ball to rotate and a component $f_d$ to cause the ball to move into the housing 4 when it is struck by a snowplow blade at the point indicated by arrow B. Preferably the angle $\phi$ is less than about 135° and even more preferably less than about 120°. As can be seen from the illustration in FIG. 4*a*, a prior art marker having a ball that projects substantially one-half above the road surface will direct the force of the snowplow blade (received at the point indicated by arrow A) primarily horizontally causing damage to the marker.

The spider 5 is constructed to provide a seat 15 for the ball 8 and is so constructed that the ball 8 can rotate easily in the seat 15. Thus, the spider 5 is preferably designed so that there is a low coefficient of friction between the seat 15 and the ball 8. This can be accomplished by appropriate selection of materials or by use of bearings in the seat area of the spider or by similar equivalent means that will be readily apparent to those skilled in the art. Preferably, the contact area between the spider 5 and the ball 8 is minimized. The spider 5 also is constructed to have openings 12 to permit sand and water to pass through and not interfere with the rotation of the ball 8 when struck by a snowplow.

A spring 10 urges the spider 5 and ball 8 in constant pressure against cap 9 but permits the ball and spider to move back into the housing 4 as necessary to avoid damage and allow vehicles to pass over the marker without obstruction. Equivalent means, such as a hydraulic or pneumatic device may be substituted for the spring 10 as desired by those skilled in the art. A ring 3 is optionally used to support the spring 10 and provide the desirable compression of the spring. An end cap 2 supports the internal members of the marker within the housing 4 and lends additional stability to the marker assembly. The end cap 2 preferably has a drain hole 1 to permit water and sand to pass through.

In use the highway lane marker of this invention is permanently placed in a cored hole in a roadway so that the top surface of the housing 4 and cap 9 are flush with the road surface 6. A filler material 7 is poured or placed around the marker to set it in position. The component parts of the highway lane marker of this invention can be made of any suitable material such as, for example, both ferrous and non-ferrous metals, and plastic. Preferably the ball 8 is colored a suitable color for ease of visibility such as, for example, white, yellow, or orange, and is iridescent, phosphorescent or luminescent for night visibility. The lane marker of this invention can be used on highways, airport runways, or other similar roadways.

This invention has been described in detail with specific reference to the preferred embodiments thereof, however, it will be realized that modifications within the spirit and scope of this invention can be effected by those skilled in the art.

I claim:

1. A marker to be embedded substantially below the grade of a roadway and having a portion projecting above the grade, said marker comprising:

a housing;

a substantially spherical member resiliently and rotatably supported in said housing;

cap means for retaining a major portion of said spherical member within said housing while permitting a portion of said spherical member to project from said housing;

support means for supporting said spherical member within said housing so that said spherical member can rotate within said housing when the portion of said spherical member that projects from said housing receives an impact parallel to the roadway; and means for resiliently supporting said support means and said spherical member to allow axial movement of said support means and said spherical member within said housing.

2. The marker of claim 1 wherein said housing is a cylinder.

3. The marker of claim 1 wherein said spherical member is a iridescent, phosphorescent or luminescent ball.

4. The marker of claim 3 wherein said spherical member has a color selected from white, yellow or orange.

5. The marker of claim 1 wherein said cap means is removably retained in said housing.

6. The marker of claim 1 wherein said resilient support means is a spring.

7. The marker of claim 1 wherein an angle formed by a cone having its apex at the center of said spherical member and its base at the line of intersection of said spherical member and said grade is less than about 150°.

8. The marker of claim 7 wherein said angle is less than 135°.

* * * * *